US008107649B2

(12) United States Patent
Akino

(10) Patent No.: US 8,107,649 B2
(45) Date of Patent: Jan. 31, 2012

(54) RIBBON FOR RIBBON MICROPHONE, MANUFACTURING METHOD OF THE SAME, AND RIBBON MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 431 days.

(21) Appl. No.: 12/369,969

(22) Filed: Feb. 12, 2009

(65) Prior Publication Data

US 2009/0208038 A1 Aug. 20, 2009

(30) Foreign Application Priority Data

Feb. 15, 2008 (JP) ..... 2008-033978

(51) Int. Cl.
*H04R 25/00* (2006.01)

(52) U.S. Cl. ..... 381/176; 381/399

(58) Field of Classification Search ..... 381/176, 381/374, 375, 399, 412, 414
See application file for complete search history.

(56) References Cited

U.S. PATENT DOCUMENTS

2009/0116670 A1* 5/2009 Akino ..... 381/176

FOREIGN PATENT DOCUMENTS

JP 2007-049324 A 2/2007
JP 2008-187311 A 8/2008

OTHER PUBLICATIONS

Harry F. Olson, "A History of High-Quality Studio Microphones", Dec. 1976, Journal of the Audio Engineering Society, vol. 24, Issue 10, pp. 798-807.
Harry F. Olson, "Microphones for Recording", Jun. 1970, Journal of the Audio Engineering Society, vol. 18, Issue 3, pp. 263-268.
Harry F. Olson, "Ribbon Velocity Microphones", Nov. 1977, Journal of the Audio Engineering Society, vol. 25, Issue 10/11, pp. 676-684.

* cited by examiner

*Primary Examiner* — Hoai V Pham
(74) *Attorney, Agent, or Firm* — Sughrue Mion, PLLC

(57) ABSTRACT

A ribbon for a ribbon microphone having a magnet forming a magnetic gap, the ribbon which is arranged in the magnetic gap and is vibrated by a sound wave, an electrode for outputting an electric signal which is generated when the ribbon vibrates in the magnetic gap, and a frame for holding the magnet and the electrode; the ribbon has patterns of a large waveform which are formed so as to progress in a longitudinal direction of the ribbon and are formed so that ridge lines face a direction which perpendicularly crosses the longitudinal direction of the ribbon, and small patterns which are smaller than the patterns of the waveform and are formed along the longitudinal direction of the ribbon.

4 Claims, 8 Drawing Sheets

RELATED ART

RELATED ART

RELATED ART

RELATED ART

RELATED ART

RIBBON FOR RIBBON MICROPHONE, MANUFACTURING METHOD OF THE SAME, AND RIBBON MICROPHONE

BACKGROUND OF THE INVENTION

1. Field of the Invention

The invention relates to a ribbon for a ribbon microphone which can reduce deterioration of a frequency response caused by a partial resonance of the ribbon, a manufacturing method of the same, and the ribbon microphone.

2. Description of the Related Art

A ribbon microphone is mainly comprised of magnets for forming a magnetic field and a ribbon. The magnets are supported on both sides of a frame so as to sandwich the ribbon and the magnetic field is formed between the magnets on both sides. The ribbon is arranged in the magnetic field in a state where a proper tension has been applied to the ribbon and both edge portions in the length direction have been pressed. When the ribbon receives a sound wave and vibrates in the magnetic field, a current according to the sound wave flows in the ribbon and the sound wave is converted into an electric signal. Hitherto, aluminum foil has widely been used as a material of the ribbon. Aluminum is suitable as a ribbon of the ribbon microphone because its conductivity is better and its specific gravity is lower as compared with those of other metal materials.

FIG. 5 shows an example of a general ribbon microphone in the related art. FIGS. 6 and 7 show a ribbon microphone unit built in the ribbon microphone. In FIG. 5, a box of a ribbon microphone 1 is comprised of a cylindrical base 6 and a microphone case 2 coupled with an upper edge of the base 6. In this box, a ribbon microphone unit 3 is assembled to a proper supporting member fixed to the base 6. The microphone unit 3 is covered with the microphone case 2. A lower edge of the base 6 is a connector 16 for connecting a microphone cable to guide an output signal of the microphone to an external circuit.

As also shown in FIGS. 6 and 7, the ribbon microphone unit 3 has a frame 7 formed in a rectangular frame die which is long in the vertical direction. A pair of permanent magnets 4 are fixed to inside surfaces of the frame 7 on both sides along the long-side direction at a predetermined interval between the permanent magnets 4. The permanent magnets 4 have been polarized in the width direction (right/left direction in FIGS. 5 and 6). The polarizing directions of the pair of permanent magnets 4 are the same direction and a parallel magnetic field is formed between the permanent magnets 4.

A ribbon 5 serving as a diaphragm and a conductive material is arranged in the parallel magnetic field. The ribbon 5 is an elongated belt-shaped member. Both edge portions in the length direction of the ribbon 5 are fixed to electrode lead-out portions 18 provided in both edge portions in the length direction of the frame 7. The electrode lead-out portions 18 are insulated from the frame 7. Tightening members 8 for sandwiching the edge portions in the length direction of the ribbon 5 are arranged in the electrode lead-out portions 18. The both edge portions in the length direction of the ribbon 5 is sandwiched by the tightening members 8 forming a pair respectively, so that the ribbon 5 and the tightening members 8 are made conductive and the ribbon 5 is held in a state where the moderate tension has been applied to the ribbon 5. In the both edge portions of the ribbon 5, portions 51 other than the portions locating in the electrode lead-out portions 18 are alternately bent at a predetermined interval, so that they are formed in a corrugated shape. The directions of the lines formed by the bending, that is, the directions of the lines drawn by a top portion and a bottom of the waveform coincide with the width direction of the ribbon 5 and those lines are formed at a predetermined interval. The portions formed in the corrugated shape in the both edge portions of the ribbon 5 are assumed to be the corrugated edge portions 51 hereinbelow. Terminal plates 9 are overlaid onto the tightening members 8 of the both edge portions. The terminal plates 9 are electrically conductive to each of the edge portions of the ribbon 5 through the tightening members 8, thereby allowing a signal from the ribbon microphone unit 3 to be outputted from each terminal plate 9. An intermediate portion of the ribbon 5 sandwiched by the corrugated edge portions 51 on both sides is a corrugated intermediate portion 52 in which a top and a bottom of a triangular wave are formed along the line in the length direction which perpendicularly crosses the directions of the lines drawn by the top and the bottom of the waveform of each of the corrugated edge portions 51, that is, the length direction of the ribbon 5.

The ribbon 5 receives the sound wave and vibrates according to the sound wave. The vibrating direction is a direction which traverses a magnetic flux between the permanent magnets 4. When the ribbon 5 made of the conductive material traverses the magnetic flux, the ribbon 5 generates an electric power and an electric signal is generated between the both edges in the length direction of the ribbon 5, accordingly, between the electrode lead-out portions 18. Since the electric signal is a signal having a frequency and an amplitude corresponding to a frequency and an amplitude of the ribbon 5, the sound wave which is applied to the ribbon 5 is converted into an electric signal corresponding to the sound wave. Since the ribbon microphone is an inertia control type microphone, it is necessary to set a resonance frequency of the ribbon 5 to a frequency which is equal to or lower than a low-band frequency of the sound wave to be collected, in other words, a frequency lower than the lowest frequency of a frequency band of the sound which can be collected. For this purpose, the tension of the ribbon 5 is set to an extremely low. As mentioned above, by bending the ribbon 5 into the corrugated shape, the low tension is realized.

In the example of the ribbon microphone described above, the intermediate portion in the length direction of the ribbon 5 sandwiched by the corrugated edge portions 51 is the corrugated intermediate portion 52 in which the top portion and the bottom of the triangular wave are formed along the line in the length direction of the ribbon 5. Ribbons of many ribbon microphones in the related art are formed in such a manner that the directions of the lines drawn by the top portion and the bottom of the triangular wave coincide with the width direction of the ribbon in the whole length direction. In other words, they are formed so that the triangular wave progresses in the whole length direction. To manufacture the ribbons of such a form, a pair of two spur gears in which teeth each constructed by a mountain and a valley of a triangular wave are formed around an outer periphery at a predetermined interval have been used in the related art. As a pair of spur gears, the gears of exactly the same specifications as well as a pitch of teeth and a radius are used. The manufacturer puts the pair of spur gears onto a flat and smooth plate such as a glass plate, sandwiches the aluminum foil as a material of the ribbon 5 by the pair of spur gears, rotates the pair of spur gears in the opposite directions while mutually pressing, and feeds out the material. In this manner, the form of the teeth of the pair of spur gears is transferred to the material and the ribbon of the waveform as mentioned above is formed.

According to the ribbons which are manufactured as mentioned above, since the material is the metal foil made of aluminum or the like, resonance sharpness of the mechanical resonance is high. That is, a peak due to the resonance appears sharply. Therefore, a problem exists in that the resonance appears in the frequency response and the sound wave cannot be converted into the electric signal with fidelity. FIG. 8 illustrates a state of occurrence of a partial resonance in the ribbon formed in such a manner that the directions of the lines drawn by the top and the bottom of the triangular wave coincide with the width direction in the whole length direction. The partial resonance occurs in the portions corresponding to one period and half period of the triangular wave as shown by being surrounded by two ellipses of broken lines in FIG. 8. This is because when paying attention to the portion corresponding to the half period, since this portion has a flat surface, its rigidity is low and the resonance is liable to occur. FIG. 9 shows frequency response characteristics of the microphone using such a ribbon. An axis of abscissa indicates a frequency and an axis of ordinate indicates an output signal level (unit: dBV). Two lines shown on the upper side of this graph indicate measurement results obtained by measuring at the front and rear of the microphone. Two lines shown on the lower side of this graph indicate measurement results obtained by measuring on the right and left of the microphone. Since the characteristics at the front and rear are important in the ribbon microphone, when paying attention to the characteristics at the front and rear, sharp peaks appear periodically. They are caused due to the foregoing partial resonance.

The partial resonance as mentioned above appears clearly in the ribbon formed in such a manner that the directions of the lines drawn by the top and the bottom of the triangular wave coincide with the width direction in the whole length direction. However, the partial resonance also appears in the ribbon formed with the corrugated intermediate portion 52 in which the top and the bottom of the triangular wave are formed along the line in the length direction of the ribbon as shown in FIGS. 5 to 7. This is because the portion corresponding to the half period of the triangular wave has also a flat surface and its rigidity is low.

As a countermeasure for improving such a problem in the related art, it is considered that the invention disclosed in Patent Document 1 (JP-A-2007-49324) which has been proposed by the present inventor before is adopted. The invention disclosed in Patent Document 1 relates to a manufacturing method of a ribbon for a ribbon microphone constructed in such a manner that a material of the ribbon is put onto the surface of a transfer mold formed in the same shape as that of the ribbon to be molded and is temporarily fixed and a roller having an elastic member on an outer circumferential surface is rolled while pressing the elastic member to the material of the ribbon, thereby transferring the surface shape of the transfer mold onto the material of the ribbon. According to Patent Document 1, by subjecting embossing or satin finish to the surface of the intermediate portion in the length direction of the transfer mold, the embossing finished or satin finished shape is transferred to the intermediate portion in the length direction of the ribbon, so that a rigidity of the length directional intermediate portion is high to a certain extent.

In Patent Document 1, there is also such a disclosure that it is preferable to form the elastic member of the roller by electrostatic flocking.

According to the invention disclosed in Patent Document 1, the rigidity of the length directional intermediate portion of the ribbon can be increased to a certain extent. However, even if the shape such as embossing finished or satin finished shape is formed, the rigidity of the ribbon cannot be sufficiently increased and the problem of the partial resonance cannot be solved.

SUMMARY OF THE INVENTION

The invention is made in consideration of the problem in the related art as mentioned above and it is an object of the invention to provide a ribbon for a ribbon microphone which can suppress a partial resonance and to provide a manufacturing method of such a ribbon. Another object of the invention is to provide a ribbon microphone in which by using such a ribbon, an inconvenience based on a partial resonance is not caused in frequency response characteristics.

According to a most principal feature of a ribbon for a ribbon microphone of the invention, there is provided a ribbon for a ribbon microphone having a magnet forming a magnetic gap, the ribbon which is arranged in the magnetic gap and is vibrated by a sound wave, an electrode for outputting outside an electric signal which is generated when the ribbon vibrates in the magnetic gap, and a frame for holding the magnet and the electrode, comprising: patterns of a large waveform which are formed so as to progress in a longitudinal direction of the ribbon and are formed in a manner that ridge lines face a direction which perpendicularly crosses the longitudinal direction of the ribbon; and small patterns which are smaller than the patterns of the waveform and are formed along the longitudinal direction of the ribbon.

According to another principal feature of the invention, there is provided a manufacturing method of a ribbon for a ribbon microphone having the above feature, comprising: a manufacturing step of a transfer mold for molding a ribbon; and a transfer step of transferring a waveform of the transfer mold by pressing a material of the ribbon to a corrugated surface formed on the transfer mold, wherein the manufacturing step of the transfer mold has a cutting step of forming patterns having a waveform which progress in a longitudinal direction of the transfer mold and in which ridge lines of the waves face a direction which perpendicularly crosses the longitudinal direction of the transfer mold and an etching step of forming small patterns which are smaller than the patterns of the waveform of the transfer mold and are arranged along the longitudinal direction of the transfer mold.

If the ribbon is comprised only of the patterns of the large waveform which are formed so as to progress in the longitudinal direction of the ribbon and are formed in a manner that the ridge lines face the direction which perpendicularly cross the longitudinal direction of the ribbon, the partial resonance occurs as mentioned above. However, by forming the small patterns smaller than the patterns of the waveform along the longitudinal direction of the ribbon together with the large patterns, concave and convex portions according to the small patterns are also formed in the portions corresponding to the half period of the waveform, so that the rigidity increases and the occurrence of the partial resonance is suppressed. Therefore, if the ribbon microphone is constructed by assembling the ribbon into the ribbon microphone unit and by assembling the microphone unit into a microphone case, it is suppressed that the sharp resonance appears in the frequency response characteristics, and the good frequency response characteristics can be obtained.

According to the manufacturing method of the ribbon for the ribbon microphone of the invention, in spite of a fact that the ribbon has the complicated shape comprised of the patterns of the large waveform which progress in the longitudinal direction and the small patterns which are smaller than the patterns of the waveform and are arranged in the longitudinal direction of the ribbon, the ribbon for the ribbon microphone can be easily manufactured merely by transferring the surface shape of the transfer mold to the material of the ribbon.

According to the transfer mold, since the patterns of the large waveform are formed by the cutting process and the small patterns are formed by the etching process, the transfer mold can be also easily manufactured.

BRIEF DESCRIPTION OF THE DRAWINGS

FIGS. 1A and 1B show an embodiment of a ribbon for a ribbon microphone according to the present invention and a transfer mold which is used to manufacture the ribbon, in which FIG. 1A is a front view of the ribbon and FIG. 1B is a cross sectional view of the transfer mold;

FIGS. 2A and 2B likewise show the ribbon for the ribbon microphone according to the above embodiment and the transfer mold which is used to manufacture the ribbon, in which FIG. 2A is a front view of the ribbon and FIG. 2B is a bottom view of the transfer mold;

FIGS. 3A and 3B show the transfer mold, in which FIG. 3A is an enlarged front view with a part in the length direction cut away and FIG. 3B is a side sectional view;

DETAILED DESCRIPTION OF THE INVENTION

Embodiments of a ribbon for a ribbon microphone according to the invention, a manufacturing method of the ribbon, and the ribbon microphone will be described hereinbelow with reference to the drawings.

Figure 1A:
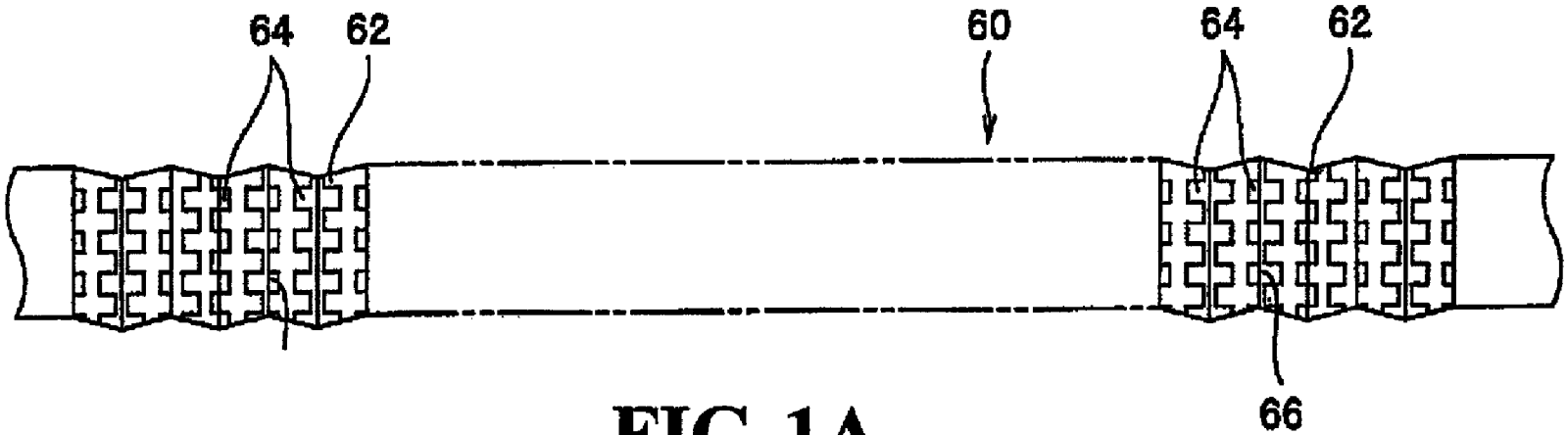
Figure 1B:
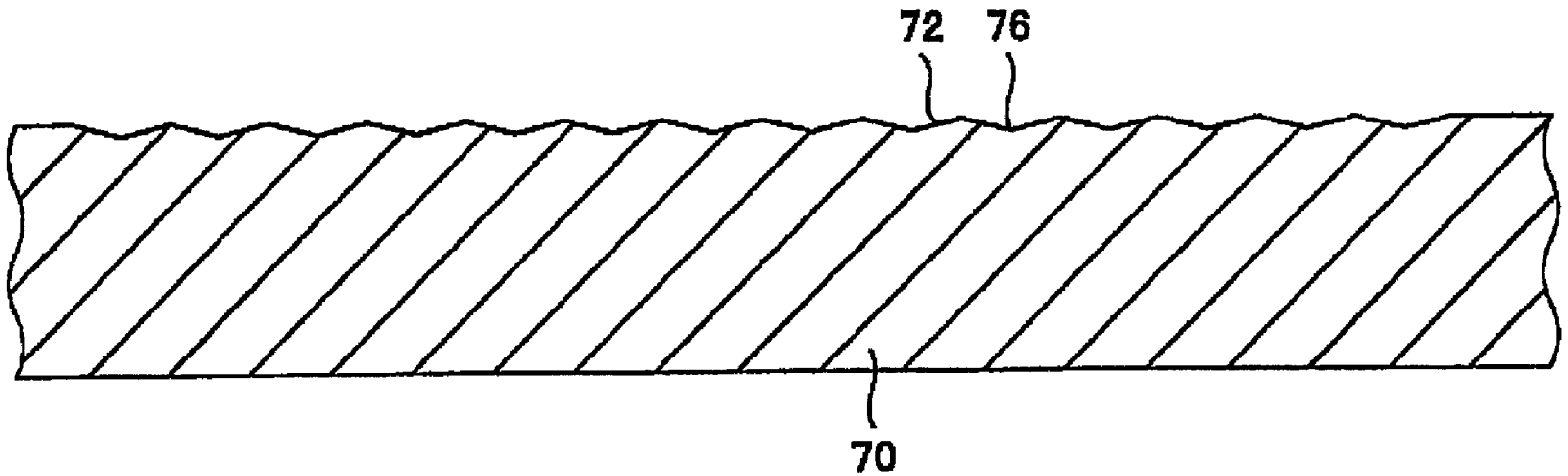

FIG. 1A shows an embodiment of the ribbon for the ribbon microphone (hereinbelow, referred to as a "ribbon") according to the present invention. FIG. 1B shows an example of a transfer mold for embodying one of manufacturing steps of the ribbon. In FIG. 1A, a ribbon 60 is made of metal foil such as aluminum foil having a thickness of a few μm. Patterns 62 of a large waveform; and patterns 64 each of which is smaller than the pattern 62 having such a waveform and is formed along the longitudinal direction of the ribbon 60 are formed on the ribbon 60 (hereinbelow, such patterns are referred to as "small patterns"). The pattern 62 of the large waveform has a cross sectional shape of a triangular waveform and is formed so as to progress in the longitudinal direction of the ribbon 60 and is formed in such a manner that a ridge line 66 faces the direction which perpendicularly crosses the longitudinal direction of the ribbon 60.

As shown in FIG. 1A, a number of small patterns 64 are arranged in the longitudinal direction of the ribbon 60 and are also arranged at a plurality of positions in the width direction of the ribbon 60, that is, in the direction which perpendicularly crosses the longitudinal direction of the ribbon 60. Each small pattern 64 is a rectangular pattern and is arranged in such a manner that its long-side direction faces the longitudinal direction of the ribbon 60. The rectangular small patterns 64 are arranged at a plurality of positions in the width direction of the ribbon 60 in such a manner that the positions in the long-side direction are alternately deviated in the longitudinal direction of the ribbon 60. Therefore, the small patterns 64 are formed in a zigzag arrangement.

Subsequently, an embodiment of the manufacturing steps of the ribbon 60 will be described. The manufacturing steps of the ribbon 60 on which the patterns 62 of the waveform and the small patterns 64 have been formed are mainly comprised of: a manufacturing step of the transfer mold for molding the ribbon; and a transfer step of transferring a waveform of the transfer mold by pressing a material of the ribbon onto the corrugated surface formed on the transfer mold.

FIGS. 1B, 2B, 3A, and 3B show an example of a transfer mold 70 adapted to manufacture the ribbon 60 by forming the patterns 62 and the small patterns 64 onto, for example, the aluminum foil as a material of the ribbon. The transfer mold 70 has a corrugated surface 72 having a cross sectional shape of a triangular waveform adapted to transfer the patterns 62 of the waveform of the ribbon 60. The corrugated surface 72 has a small pattern transfer surface comprised of small patterns arranged in such a manner that a number of small patterns are arranged along the longitudinal direction of the transfer mold 70 and small patterns are arranged at a plurality of positions in the width direction of the transfer mold 70. The small pattern transfer surface is a surface for transferring the small patterns 64. The corrugated surface 72 is formed so as to progress in the longitudinal direction of the transfer mold 70 and is formed in such a manner that a ridge line 76 faces the direction which perpendicularly crosses the longitudinal direction of the transfer mold 70. The small pattern transfer surface is comprised of an infinite number of rectangular patterns. Those patterns are arranged at a plurality of positions in the width direction of the transfer mold 70 in such a manner that the long-side direction faces the longitudinal direction of the transfer mold and the positions in the long-side direction are alternately deviated in the longitudinal direction of the transfer mold 70.

Figure 3A:
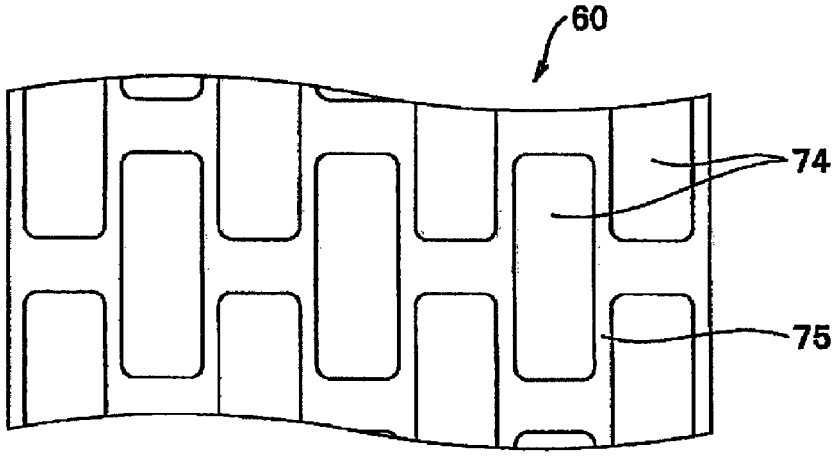
Figure 3B:
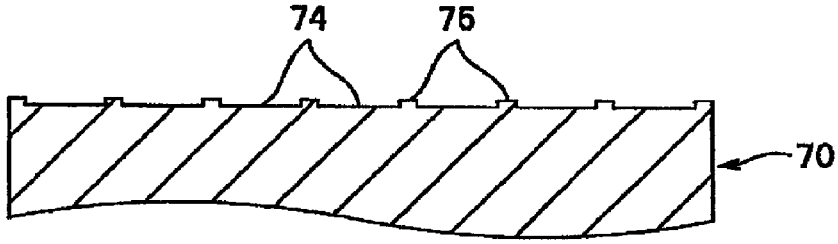

The corrugated surface 72 of the transfer mold 70 is formed by mechanically cutting, for example, a metal block serving as a material of the transfer mold. After the corrugated surface 72 was formed onto the transfer mold 70, by etching the corrugated surface 72, the small pattern transfer surface is formed. A well-known method may be used as an etching method. For example, the whole surface of the corrugated surface 72 is coated with a photo resist and the photo resist is exposed according to a desired pattern, thereby forming a pattern having exposed portions and unexposed portions. Subsequently, by executing an etching process, the small pattern transfer surface is formed. As shown in FIGS. 3A and 3B, the small pattern transfer surface is constructed by: concave portions 74 formed by removing the surfaces by etching; and convex portions 75. Each concave portion 74 is surrounded by the convex portions 75. The concave portions 74 and the convex portions 75 which form the small pattern transfer surface are arranged at a plurality of positions in the width direction of the transfer mold 70 in such a manner that the long-side direction of each rectangle faces the longitudinal direction of the transfer mold 70 and the positions in the long-side direction are alternately deviated in the longitudinal direction of the transfer mold 70.

Specifically speaking, one pitch of the small patterns 64 in the longitudinal direction of the ribbon 60 is set to, for example, 2.48 mm. A pitch of the pattern 62 of the waveform may be equal to or different from such a value. A depth of concave portion 74 in the transfer mold 70 to form the small patterns 64 is preferably set to about 0.05 mm. It is desirable that a corner of each convex portion 75 is finished into a shape which is chamfered like an arc so as not to be sharp. This is because if the corner of the convex portion 75 is sharp, in the transfer step, which will be described hereinbelow, the ribbon material is liable to be split when it collides with the sharp corner.

Subsequently, the process advances to the transfer step using the transfer mold 70 formed as mentioned above. The surface shape of the transfer mold 70 is transferred to the ribbon material. The transfer step is executed as follows. The ribbon material made of the metal foil cut into an elongated shape is put onto the corrugated surface 72 of the transfer mold 70. The ribbon material is pressed to the corrugated surface by pressing a soft brush-like member onto the ribbon material. As a brush-like member, for example, a flocking roller formed by uniformly arranging fibrous hair onto the surface can be used. The fibrous hair is made of short fibers and a length and a thickness of the fiber are determined according to a size and a depth of each of the concave and convex portions of the corrugated surface 72 of the transfer mold 70. It is preferable to use an electrostatic flocking technique in order to obtain a flocked surface having such specifications.

While pressing the hair of the flocking roller onto the material of the ribbon, the flocking roller is rolled in the longitudinal direction of the material. Merely by lightly pressing the hair of the flocking roller onto the material, the shape of the corrugated surface 72 of the transfer mold 70, that is, the patterns 62 of the large waveform and the small patterns 64 are transferred onto the material. As a transfer step using such a flocking roller, a transfer step similar to that disclosed in Patent Document 1 can be used.

Figure 2A:
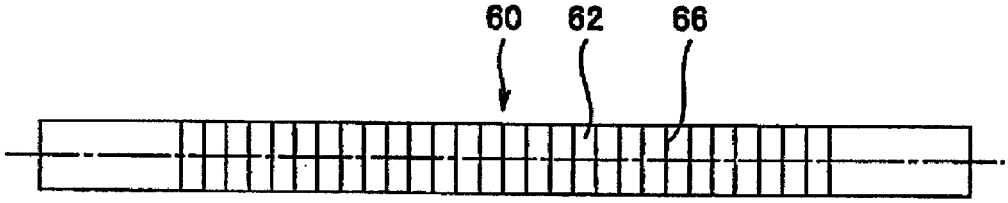
Figure 2B:
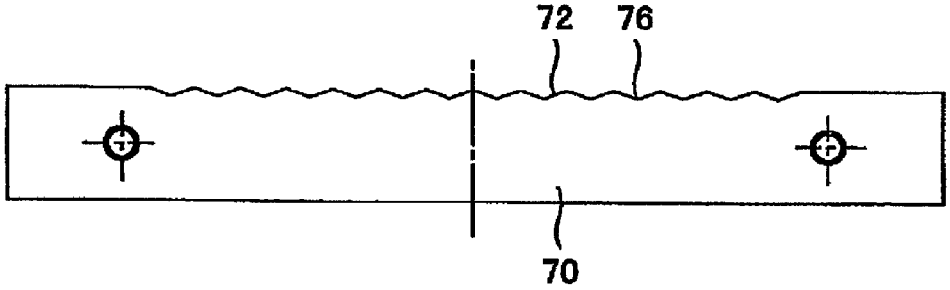

FIG. 2A shows only a state where the patterns 62 of the large waveform have been formed onto the material of the ribbon 60 and a drawing of the small patterns 64 is omitted. FIG. 1A shows a state where the small patterns 64 have been formed together with the patterns 62. In FIG. 2A, ridge lines 66 are caused on the patterns 62 of the waveform. The ridge lines 66 face the direction which perpendicularly crosses the longitudinal direction of the ribbon, that is, the width direction of the ribbon.

The material of the transfer mold 70 may be either a metal or plastics. It is preferable that a proper number of exhaust holes which penetrate from the back surface (bottom surface) to the front surface of the transfer mold 70 are formed in the transfer mold 70 in order to temporarily fix the ribbon material put on the surface of the transfer mold 70. By putting the ribbon material onto the corrugated surface 72 of the transfer mold 70, evacuating the transfer mold 70 through the exhaust holes, and setting a space between the corrugated surface 72 of the transfer mold 70 and the ribbon material into a negative pressure, the ribbon material can be temporarily fixed onto the surface of the transfer mold 70. It is sufficient to set an exhaust pressure to such a weak negative pressure that a positional deviation of the ribbon material does not occur.

As a brush-like member, a flocking brush of a flat type may be used in place of the flocking roller. As a flat-shaped flocking brush, a brush formed by uniformly flocking the fibrous hair onto almost the whole lower surface of a flat plate-shaped weight having a proper weight may be used.

In the case of transferring by using the brush formed by flocking the lower surface of the flat plate-shaped weight, it is preferable to attach the transfer mold 70 onto a vibrator (not shown). The transfer mold 70 is attached onto the vibrator, the ribbon material is put onto the transfer mold 70, and it is temporarily fixed if necessary. The flat plate-shaped flocking brush is put onto the ribbon material so that the hair is come into contact with the ribbon material. The vibrator is activated. A vibration is applied to the transfer mold 70, the ribbon material, and the flocking brush by the vibrator, so that the flocking brush moves relatively to the ribbon material. The weight of the whole flocking brush is dispersed and applied to the ribbon material through each piece of soft hair of the flocking brush, the ribbon material is pressed onto the corrugated surface 72 of the transfer mold 70, and the waveform of the corrugated surface 72 is transferred to the ribbon material.

As a technique for transferring the waveform to the ribbon by using the vibrator and the brush obtained by flocking the fibrous hair onto the lower surface of a flat plate-shaped weight as mentioned above, a technique disclosed in Japanese Patent Application No. 2007-273127 according to the application of the present applicant may be used.

The corrugated surface 72 is comprised of the patterns having the large triangular waveform and the small patterns formed by the concave portions 74 and the convex portions 75. Those large patterns and small patterns are transferred to the ribbon material, so that the ribbon 60 is completed.

Figure 5:
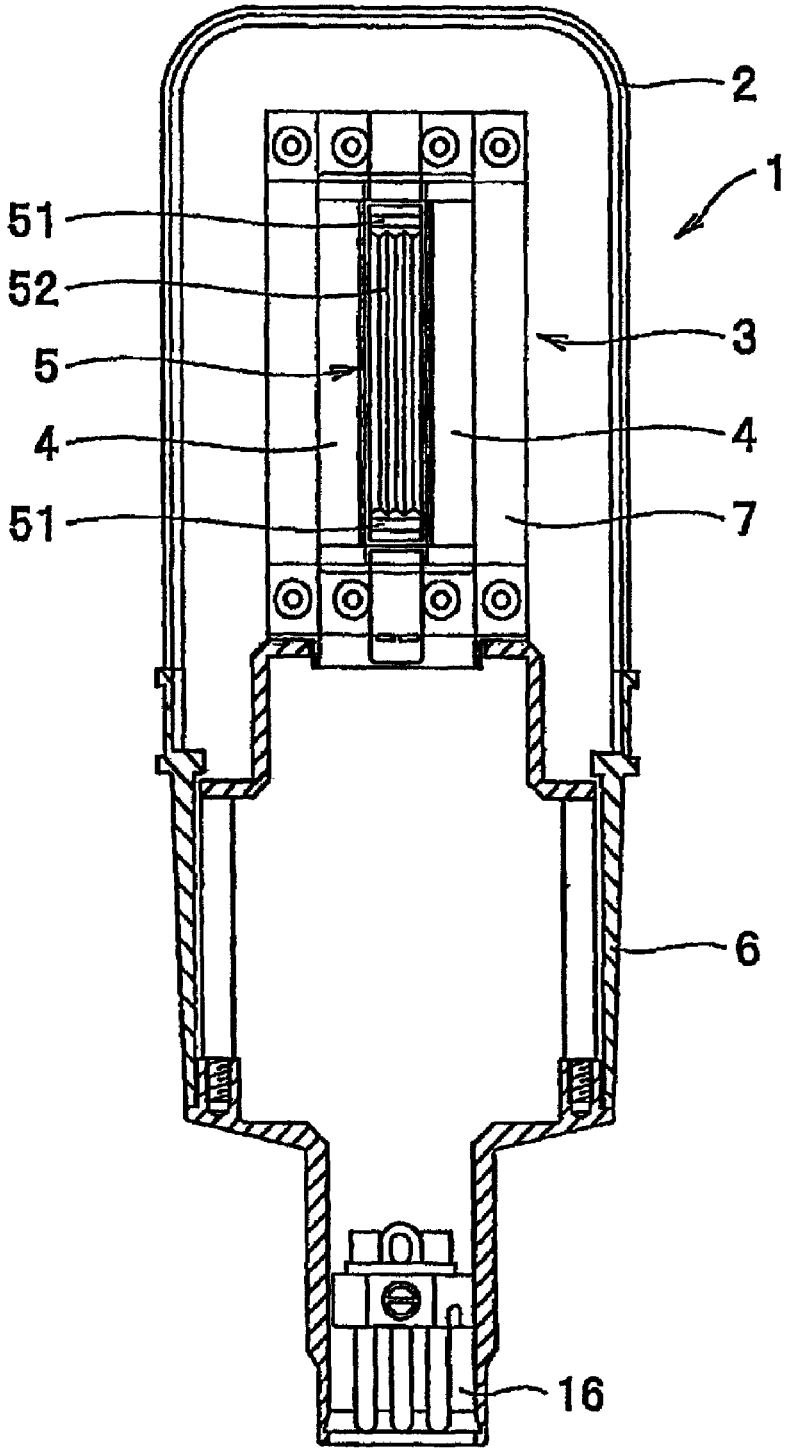
FIG. 5 is a partial cross sectional front view showing an example of an internal construction of a ribbon microphone which has been known in the related art.
Figure 6:
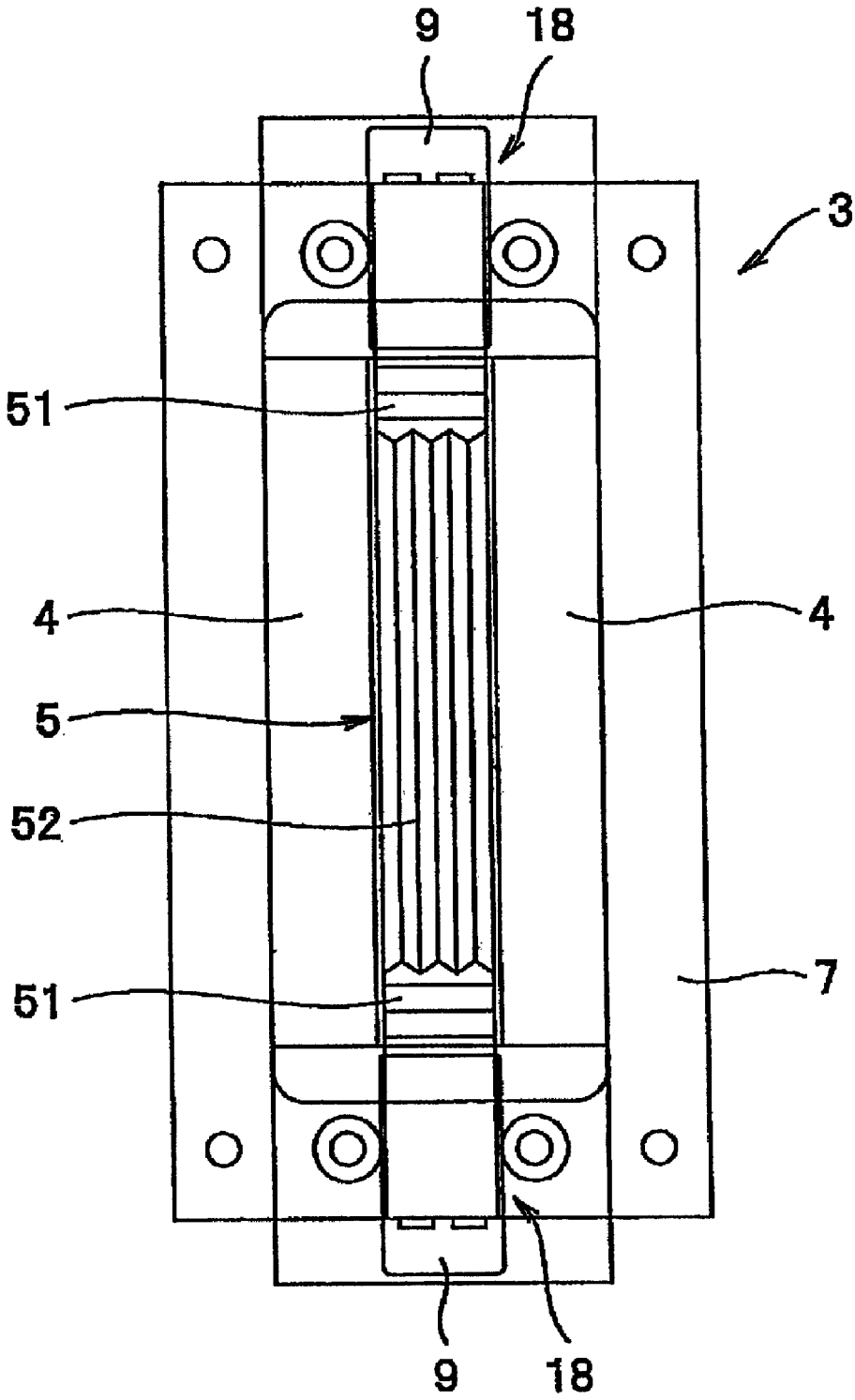
FIG. 6 is a front view showing an example of a ribbon microphone unit which has been known in the related art.
Figure 7:
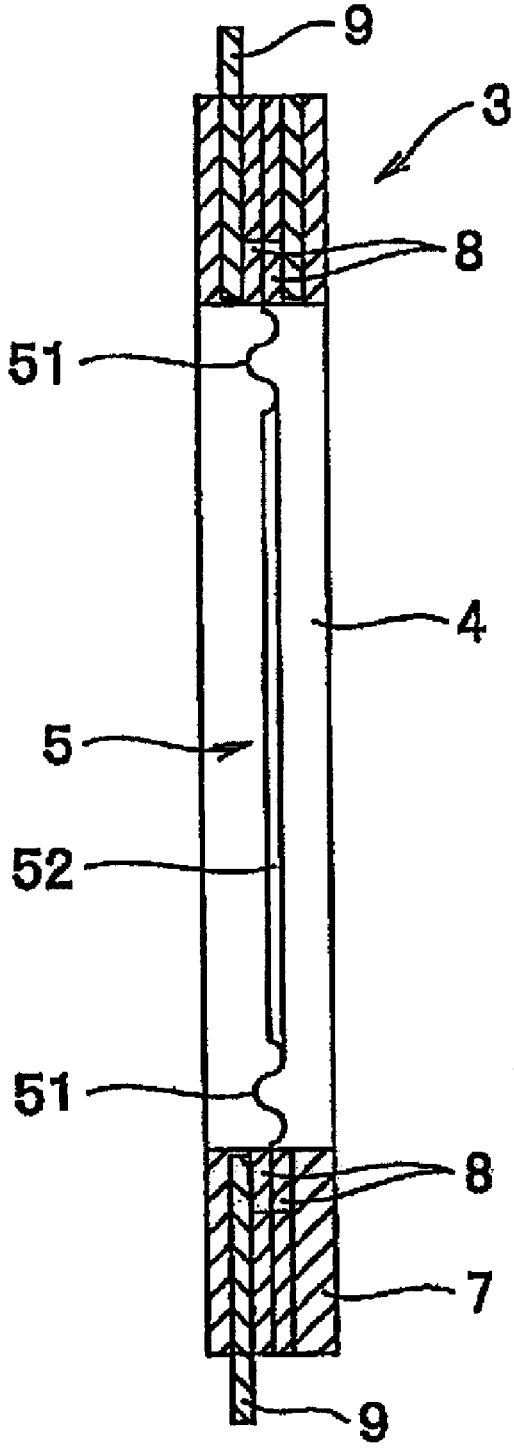
FIG. 7 is a side sectional view in the related art of the above ribbon microphone unit.
Figure 8:
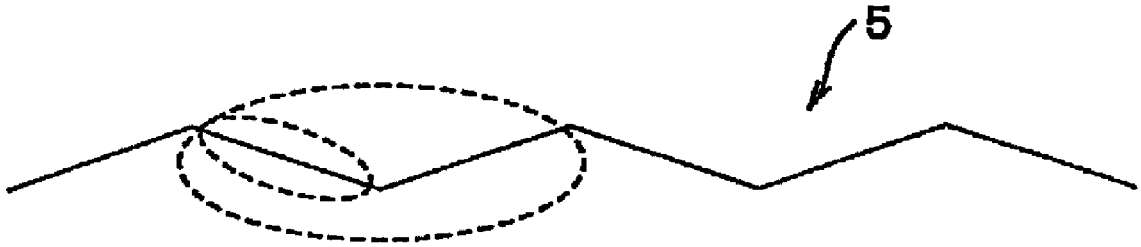
FIG. 8 is a schematic diagram for describing a partial resonance occurring in a ribbon which is used in the ribbon microphone unit in the related art.

As shown in FIGS. 6 and 7, the ribbon 60 manufactured as mentioned above is attached to the frame and arranged in the magnetic field, so that a microphone unit of the ribbon microphone is completed. When the ribbon 60 receives a sound wave, the portions of the patterns 62 of the waveform are deflected and vibrate. Since the vibrations are performed in the magnetic gap as mentioned above, electric signals according to the vibrations are generated at both ends of the ribbon 60 and electroacoustically converted. By assembling the microphone unit into a microphone case as shown in FIG. 5, the ribbon microphone can be obtained. The signal can be outputted from a connector assembled in the microphone case.

Figure 4:
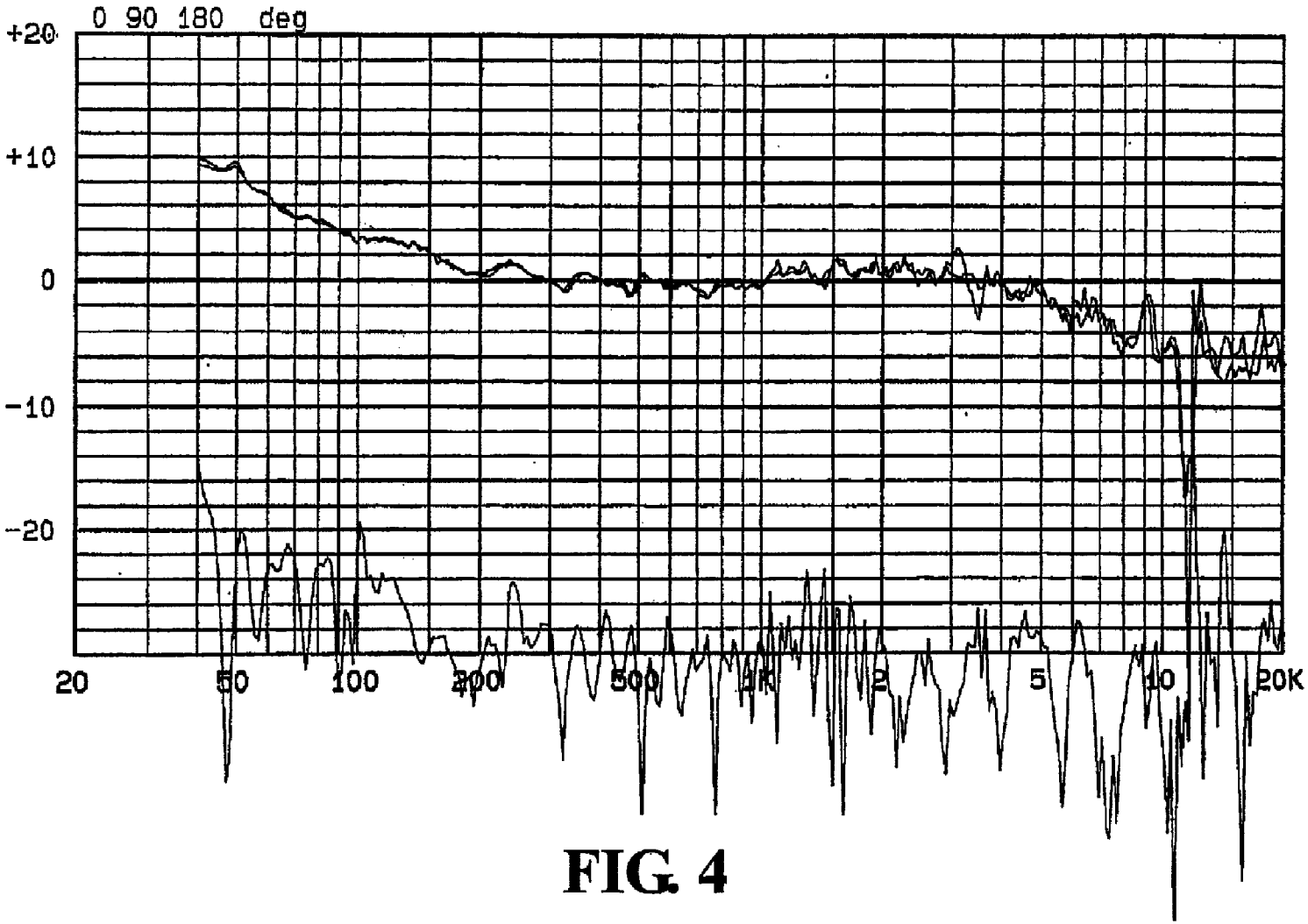
FIG. 4 is a characteristics diagram showing frequency response characteristics in an embodiment of a ribbon microphone according to the present invention.
Figure 9:
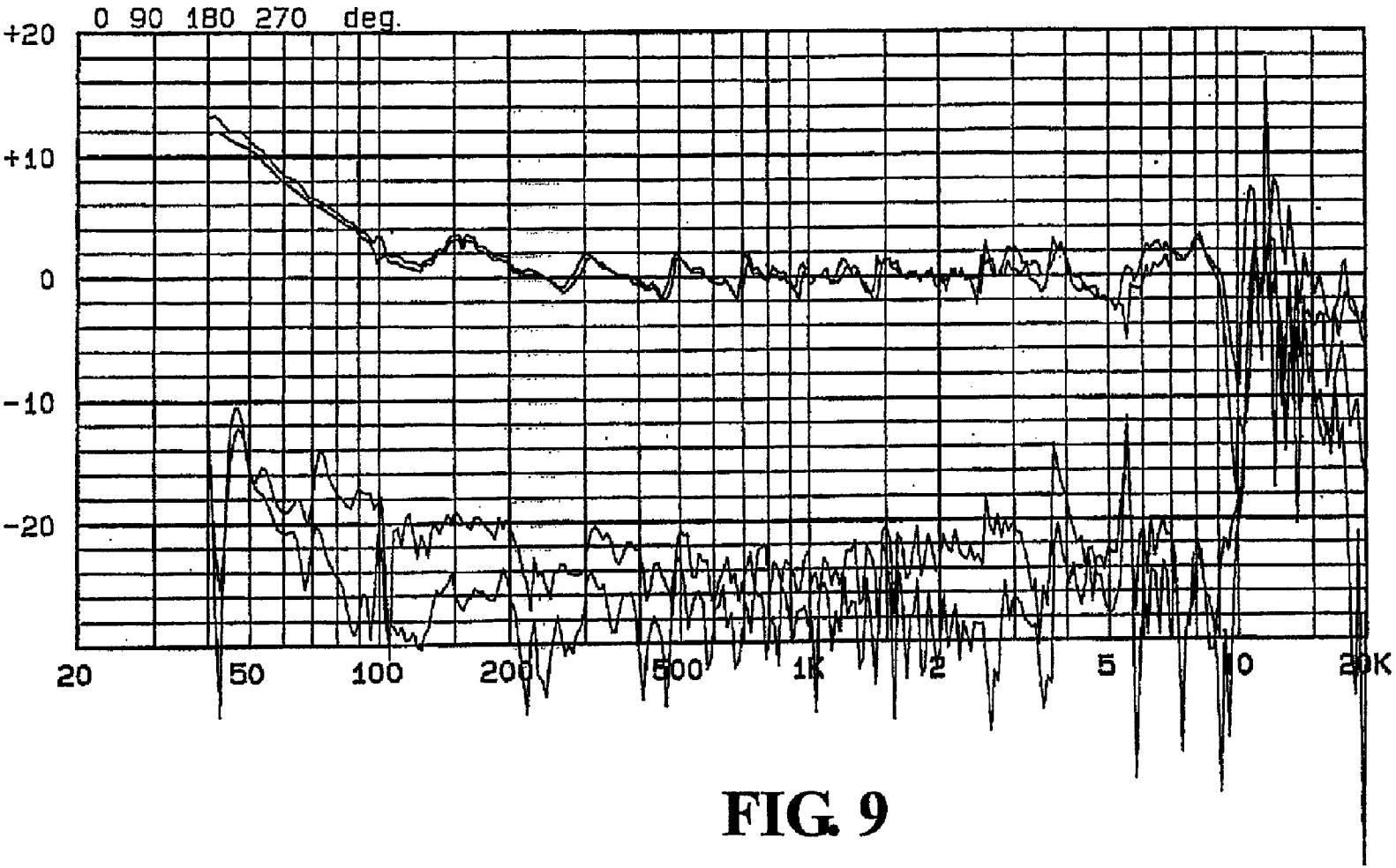
FIG. 9 is a characteristics diagram showing frequency response characteristics in an example of the ribbon microphone in the related art.

Measurement results of the frequency response characteristics of the ribbon microphone according to the embodiment of the present invention are shown in FIG. 4. The characteristics of the present invention is measured under the condition that only the configuration of the ribbon is made different but other specifications are made conformed in order to compare with the frequency response characteristics of the ribbon microphone in the related art shown in FIG. 9. When the frequency response characteristics shown in FIG. 4 are compared with the frequency response characteristics shown in FIG. 9, on the two upper characteristics diagrams showing the characteristics at the front and rear, the levels of the periodic peaks are low and the sharpness of the peaks is small. This is because by forming not only the patterns 62 of the triangular waveform but also the small patterns 64 smaller than the patterns 62 to the ribbon 60 besides the patterns 62, the rigidity of the portions of the patterns 62 of the triangular waveform increases and the partial resonance of the ribbon 60 is suppressed.

What is claimed is:

1. A ribbon for a ribbon microphone having a magnet forming a magnetic gap, the ribbon arranged in the magnetic gap and vibrated by a sound wave, an electrode for outputting outside an electric signal which is generated when the ribbon vibrates in the magnetic gap, and a frame for holding the magnet and the electrode, comprising:

patterns of a large waveform which are formed so as to progress in a longitudinal direction of the ribbon and are formed in a manner that ridge lines face a direction which perpendicularly crosses the longitudinal direction of the ribbon; and small patterns which are smaller than the patterns of the waveform and are formed along the longitudinal direction of the ribbon.

2. The ribbon according to claim 1, wherein the small patterns formed along the longitudinal direction of the ribbon are arranged in the direction which perpendicularly crosses the longitudinal direction of the ribbon.

3. The ribbon according to claim 1, wherein the small patterns formed along the longitudinal direction of the ribbon are arranged in the direction which perpendicularly crosses the longitudinal direction of the ribbon while alternately deviating positions of the small patterns.

4. A ribbon microphone obtained by assembling a ribbon microphone unit having a ribbon into a microphone case, wherein the ribbon is a ribbon according to any one of claims 1 to 3.

* * * * *